United States Patent [19]

Kullander

[11] 4,294,872

[45] Oct. 13, 1981

[54] METHOD AND AN APPARATUS FOR COATING A WEB WITH A COATING COMPOSITION

[75] Inventor: Mats O. Kullander, Säffle, Sweden

[73] Assignee: Billerud Uddeholm AB, Säffle, Sweden

[21] Appl. No.: 132,792

[22] Filed: Mar. 21, 1980

[30] Foreign Application Priority Data

Sep. 22, 1978 [SE] Sweden ..... 7809998

[51] Int. Cl.[3] ..... B05D 3/12; B05C 3/02; B05C 3/12

[52] U.S. Cl. ..... 427/358; 118/407; 118/412; 118/415; 118/419; 427/361; 427/369

[58] Field of Search ..... 118/407, 412, 415, 419; 427/356, 358, 359, 361, 369

[56] References Cited

U.S. PATENT DOCUMENTS 3,233,576 2/1966 Voelker ..... 118/106 X
3,235,400 2/1966 Voelker ..... 118/106 X

*Primary Examiner*—Michael R. Lusignan
*Attorney, Agent, or Firm*—Burns, Doane, Swecker & Mathis

[57] ABSTRACT

When a coating composition is applied to a web, the composition is applied in excess, and the excess is wiped off with the help of a portion of the web which has not yet been coated.

13 Claims, 7 Drawing Figures

METHOD AND AN APPARATUS FOR COATING A WEB WITH A COATING COMPOSITION

TECHNICAL FIELD

The invention relates to a method and an apparatus for coating a web with a coating composition by continuously conveying the web, applying the coating composition to the web in excess, and wiping off the excess from the web. By "web" is understood a web of any material, preferably a web of paper or cardboard. By "composition" is intended any liquid or semi-liquid substance or composition, e.g. a dispersion of a pigment in a liquid. The composition can also be present in the form of foam. The composition can be substantially absorbed by the web, or form a layer on the surface of the web.

BACKGROUND ART

In a coating method of the kind mentioned above, it is known that the excess of the composition can be wiped off from the web by means of a wiper, e.g. a thin blade which is pressed against the web.

DISCLOSURE OF THE INVENTION

The present invention relates to an entirely new principle for removing the excess composition from the web, and is characterized in contacting a first zone of the continuously moving web which has not yet been coated with a second zone of the web where the composition is present in excess, the first and second zones thus forming a contact zone in which the uncoated web wipes off the excess of composition from the coated portion of the web.

The first and second zones of the web may be in direct or indirect contact with each other. If they are in direct contact they shall move in opposite directions in the contact zone. An indirect contact between the two zones may be achieved by means of an intermediate wiper which wipes off the excess composition from the second zone of the web and conveys said excess composition to the first zone of the web. Such an intermediate wiper may consist of a roller or of an endless belt. In the contact zone, or in each contact zone in case of an intermediate wiper as described above, one of the contacting web zones shall be supported, i.e. carried on a firm substructure, suitably a rotating roll. The other web zone shall not be supported however, but shall be pressed against the first web zone solely by the tension in the web. The supported web zone can either constitute the wiping web zone or the coated web zone from which the excess composition is to be wiped off.

The apparatus of the invention is characterized in that it includes a support roll over which the web is continuously advanced, at least one first guide roll and a second guide roll for the web, both these guide rolls being placed in relation to the support roll such that the web portion going between the guide rolls is deflected by the support roll and forms a contact zone with the web portion supported by the support roll, and that supply means for the coating composition is arranged in the space between the two web portions extending between one guide roll and said contact zone.

An advantage with the method of the invention is that the degree of removal of the coating composition from the web can easily be regulated by regulating the length of the contact zone. Another advantage is that the risk of uncoated portions of the web is reduced or eliminated, since the web comes into contact with the coating composition twice.

DESCRIPTION OF THE DRAWINGS

The invention will now be described with reference to the drawing.

Figure 1:
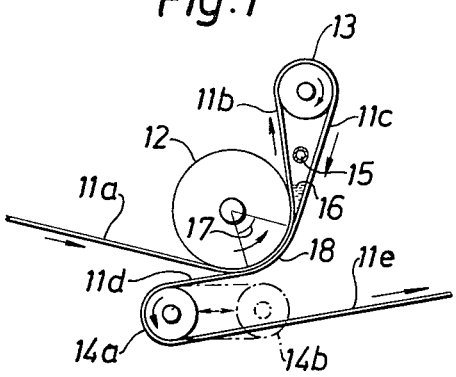
FIGS. 1 and 2 illustrate two apparatuses for coating one side of the web.

In the apparatus of FIG. 1, the incoming portion 11*a* of a web 11*a*–11*e* is taken over a support roll 12, a first stationary guide roll 13, and a second movably mounted guide roll 14*a*, 14*b*. The guide rolls 13 and 14 are placed such that the portion 11*c*, 11*d* of the web going from the first guide roll 13 to the second guide roll 14 is deflected by the support roll 12 and thus comes into contact with the portion of the web supported thereby. The zones of the web coming into contact with each other in the contact zone 18 thus formed travel in opposite directions. The length of the contact zone is determined by the angle 17. The size of this angle can be varied by setting the movable guide roll 14 in a desired position between the extreme positions 14*a* and 14*b*. A perforated tube 15 for supplying the coating composition is mounted between the space occurring between the web portions 11*b* and 11*c*. The coating composition is suitably supplied at a rate such that it forms a pool 16 in the bottom of the space between the web portions 11*b* and 11*c*. For such a pool 16 to be formed there is the requirement that the guide roll 13 is situated higher than the support roll 12. If, for some reason, it is desired to place the guide roll 13 lower than the support roll 12, the supply tube 15 can be made to spray out the coating composition in a finely divided form on the web portion 11*b* or 11*c*, or both. Whether a pool 16 is formed or not, the excess of the coating composition supplied to the web portion 11*c* will be wiped off by the incoming web portion 11*a* when it passes the contact zone 18. If the contact zone is made shorter, by the guide roll 14*a* being moved towards the position 14*b*, the amount of coating composition per unit area will increase on the outgoing coated web portion 11*d*.

No hydrodynamic pressure occurs in the pool 16, since the web portion 11*b* moves upwards while the web portion 11*c* moves downwards. The absence of hydrodynamic pressure results in that the coating composition will not be pressed into the web, contrary to the case when an excess of the coating composition is wiped off by a blade or wiper, since in the latter case a hydrodynamic pressure is created in the coating composition which is collected between the web and the blade. The method of the invention therefore enables application of a coating composition in a smaller amount per unit area than with wiping off by a blade or wiper.

Figure 2:
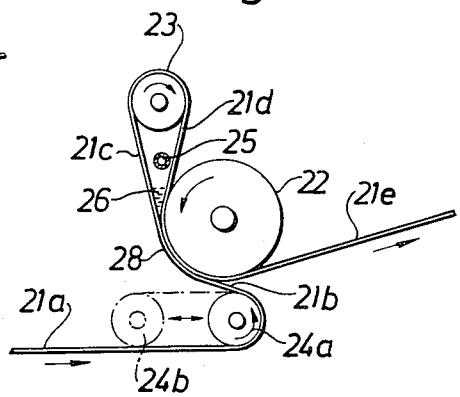

In the apparatus according to FIG. 2, the incoming portion 21*a* of a web 21*a*–21*e* is conveyed over a first movably mounted guide roll 24*a*, 24*b*, to a second guide roll 23, and a support roll 22. A supply tube 25 for a coating composition is mounted between the web portions 21*c* and 21*d* for forming a pool 26 in the space between these two web portions. The arrangement according to FIG. 2 can be said to occur if the web according to FIG. 1 is driven in the reverse direction. The apparatus according to FIG. 2 otherwise functions in the same way as the apparatus according to FIG. 1.

Figure 3:
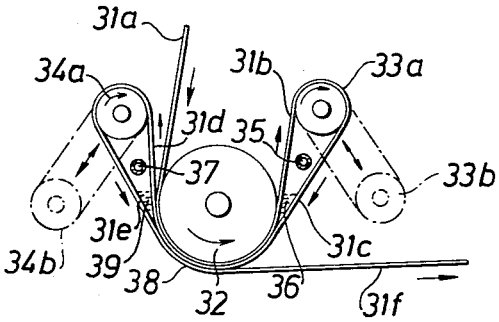
FIG. 3 illustrates an apparatus for coating two sides of a web.

In the apparatus according to FIG. 3, the web 31*a*–31*f* is conveyed over a support roll 32, a first movably mounted guide roll 33*a*, 33*b*, back again over the support roll 32, where it contacts the incoming web portion 31*a* with reverse direction of movement, further over a second movably mounted guide roll 34*a*, 34*b*, and finally once again over the support roll 32 where, in the contact zone 38, it comes into contact with the middle one of the three web portions thus being supported by the support roll 32, and with a direction of movement reverse to that of said middle portion. A supply tube 35 for a coating composition is arranged in the space between the web portions 31*b* and 31*c*, to form a pool 36. A corresponding supply tube 37 for a coating composition is arranged in the space between the web portions 31*d* and 31*e* for forming a pool 39.

The incoming web portion 31*a* will wipe off the excess of the coating composition applied by the pool 36 to the web portion 31*c*. The length of the contact zone 38 between these two web portions can be regulated by varying the position of the guide roll 33 between the end positions 33*a* and 33*b*. The uncoated side of the web portion 31*c* wipes off the excess of the coating composition applied by the pool 39 to the web portion 31*e*. The length of the contact zone 38 between these two web portions can be regulated by varying the position of the guide roll 34 between the end positions 34*a* and 34*b*. The web 31*f* leaving the apparatus will thus be coated on both sides.

Figure 4:
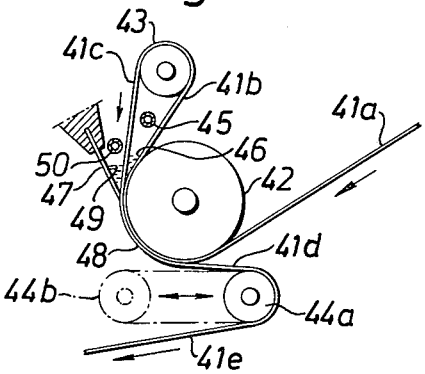
FIG. 4 illustrates an apparatus in which one side of a web is coated in accordance with the invention and one side is coated conventionally.

The apparatus according to FIG. 4 is to a large extent similar to the apparatus according to FIG. 1. Thus a web 41*a*–41*e* is conveyed over a support roll 42, a first stationary guide roll 43 and a second movably mounted guide roll 44*a*, 44*b*. A supply pipe 45 for a coating composition forms a pool 46 of coating composition between the two web portions 41*b* and 41*c*. The incoming web portion 41*a* wipes off the excess of the coating composition from the coated web portion 41*c*. One side of the web is thus coated in the way described in conjunction with FIG. 1.

A flexible blade 47 is arranged for coating the other side of the web, this blade engaging against the web portion 41*c* where the latter is supported by the support roll 42. In the space between the blade 47 and web portion 41*c* there is arranged a supply tube 50 for a coating composition which can be the same as, or different from, the composition applied via the tube 45. The coating composition from the tube 50 forms a pool 49. By increasing or decreasing the pressure of the blade 47 against the web, the amount of applied coating composition per unit area can be decreased or increased conventionally.

Figure 5:
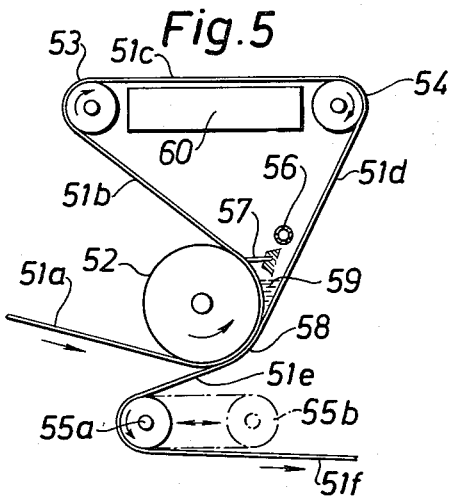
FIG. 5 illustrates an apparatus in which a drying step has been inserted between the two zones where the web is in contact with the coating composition.

In the apparatus according to FIG. 5, a web 51*a*–51*f* is conveyed over a support roll 52, a first guide roll 53, a second guide roll 54 and a third movably mounted guide roll 55*a*, 55*b*. In the space between the web portions 51*b* and 51*d* there is mounted a supply tube 56 for a coating composition which forms a pool 59, and furthermore there is also provided here a wiper in the form of a flexible blade 57 which engages against the web portion 51*b* where the latter is supported by the support roll 52. A drying unit 60 is mounted between the guide rolls 53 and 54 under the web portion 51*c*, said drier being intended for drying the coating composition on the web portion 51*c* by means of heat or an air stream, or both.

The function of the apparatus is that the blade 57 limits the amount of coating composition accompanying the web portion 51*b* to the drying portion 51*c*, so that complete drying takes place as the web passes over the drier 60. When the web is coated a second time, namely when the web portion 51*d* comes into contact with the pool 59, a further quantity of composition is applied to the web. The apparatus thus gives the opportunity of applying a greater amount of composition per unit area at a single passage of the web through the apparatus than is possible with the apparatus in accordance to FIG. 1.

Figure 6:
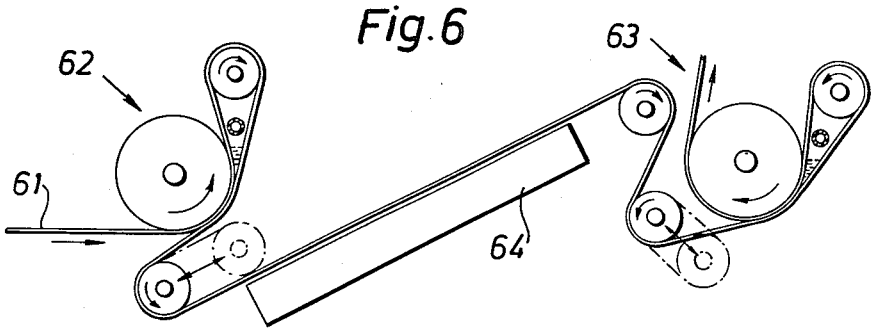
FIG. 6 illustrates an apparatus for coating both sides of a web with an intermediate drying step.

The apparatus according to FIG. 6 includes two separate apparatuses, namely the apparatus 62, which is of the same kind as described in conjunction with FIG. 1, and the apparatus 63, which is of the kind described in conjunction with FIG. 2. A web 61 is first conveyed through the apparatus 62, where one side is coated, subsequently past a drying unit 64 where the applied coating is dried, and finally through the apparatus 63 where the other side of the web is coated.

Figure 7:
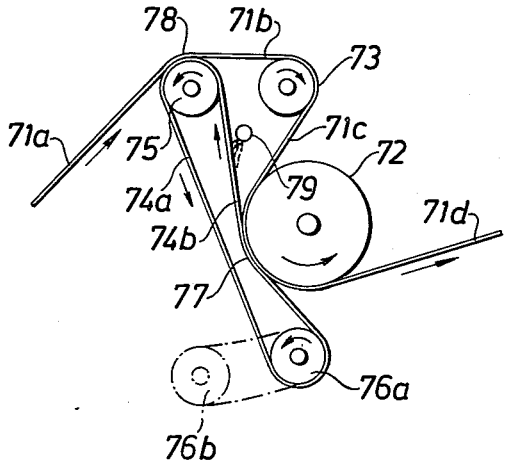
FIG. 7 illustrates an apparatus in which two zones of the web are in indirect contact with each other by means of an auxiliary wiping member.

The apparatus of FIG. 7 contains an intermediate wiper comprising an endless belt 74*a*, 74*b* supported by two rollers 75 and 76*a*, 76*b*. The latter roller is movably mounted, as indicated. Means, not shown, are provided for driving the belt 74*a*, 74*b* in the direction indicated by the arrows. The material of the belt may be, for example, plastics or a paper web.

The web 71*a*–71*d* to be coated is conveyed over the roller 75, forming a contact zone 78 with the web 74*a*, 74*b*, over a guide roll 73, and over a support roll 72. The roller 76*a*, 76*b* of the intermediate wiper is fixed in such a position that the portion 74*b* of the endless belt is deflected by the support roll 74, thus forming a contact zone 77 between the web 71*a*–71*d* and the endless belt 74*a*, 74*b*.

Coating liquid is supplied to a supply pipe 79 and is sprayed onto the portion 74*b* of the endless belt. The coating liquid may be supplied at such a rate that a pool is formed between the portion 74*b* of the endless belt and the portion 71*c* of the web being conveyed from the guide roll 73 to the support roll 72. In any case, the coating liquid carried by the portion 74*b* of the endless belt is transferred to the web portion 71*b* in the contact zone 78. In the contact zone 77 the endless belt meets the web, thus wiping off the excess of coating liquid from the web. Consequently, the endless belt 74*a*, 74*b* acts as a wiper and a conveyor, wiping off the excess of coating liquid from the coated web at the contact zone 77, delivering said excess of coating liquid to the uncoated web at the contact zone 78.

EXAMPLE

A paper web with a width of 0.5 m was treated in an apparatus of the kind illustrated in FIG. 1. The treated web was subsequently conveyed over a drying cylinder for drying. The support roll had a diameter of 250 mm. The guide rolls 13 and 14 had a diameter of 150 mm. Two paper qualities were tried. Glassine, also called pergamyn, with a surface roughness (measured according to Bendtsen) of 75 units was used in experiments 1–3, 14 and 15 in the Table below. Greaseproof paper with a surface roughness (measured according to Bendtsen) of 400 units was used for experiments 4–13. Two coating compositions were tried. An 8% solution of chromium stearate in a mixture of isopropanol and water was used for experiments 1–13. The viscosity of the solution was 5 cp. A pure liquid silicone with a viscosity of 100 cp was used for experiments 14 and 15.

The Table below illustrates how the amount of applied coating composition per unit area varied with the speed of the web and with the length of the contact zone between the two web portions.

TABLE

| Experiment No. | Web speed m/min. | Length of contact zone mm. | Applied amount gram/m$^2$ |
|---|---|---|---|
| 1 | 25 | 50 | 2.7 |
| 2 | 50 | 50 | 2.1 |
| 3 | 75 | 50 | 1.8 |
| 4 | 35 | 20 | 4.1 |
| 5 | 35 | 40 | 3.7 |
| 6 | 35 | 60 | 3.6 |
| 7 | 35 | 80 | 3.5 |
| 8 | 35 | 100 | 3.2 |
| 9 | 70 | 20 | 3.9 |
| 10 | 70 | 40 | 3.6 |
| 11 | 70 | 60 | 3.2 |
| 12 | 70 | 80 | 3.0 |
| 13 | 70 | 100 | 2.9 |
| 14 | 50 | 50 | 2.4 |
| 15 | 75 | 50 | 2.1 |

I claim:

1. A method of coating a continuously conveyed web with a coating composition, comprising the steps of:

applying a coating composition in excess to a first zone of the continuously conveyed web;

providing a backing support for one of the first zone and a second, uncoated zone of the web; and deflecting the other of the first and second zones of the web into contact with said one zone without providing a backing support for said other zone, to thereby form a contact zone such that the uncoated second zone of the web wipes excess coating composition from the coated first zone of the web.

2. A method as claimed in claim 1, further including the steps of applying the coating composition to the web at a rate such that a pool of coating composition is formed between the web portion approaching the contact zone and the web portion leaving the contact zone after having wiped off the excess of coating composition.

3. A method as claimed in claim 1, further including the steps of conveying the web over a support roll, a first guide roll, and a second guide roll which is so situated that the web portion being conveyed from the first to the second guide roll is deflected by the support roll to form a contact zone with the web portion supported by the support roll, and applying the coating composition to the web on at least one of the web portions extending between the first guide roll and the contact zone.

4. A method as claimed in claim 1, further including the steps of conveying web over a first guide roll, a second guide roll and a support roll so situated that it deflects the web portion being conveyed from the first to the second guide roll, to form a contact zone with the web portion supported by the support roll, and supplying the coating composition to the web on at least one of the web portions extending between the second guide roll and the contact zone.

5. A method as claimed in claim 1, further including the steps of conveying the web over a support roll, a first guide roll, and a second guide roll, which are so situated that the web portion being conveyed from the first to the second guide roll is deflected by the support roll to form a contact zone with the web portion supported by the support roll, and finally conveying the web over the support roll in contact with the web portion on the contact zone, and supplying the coating composition to the web on at least one of the web portions extending between the first guide roll and the contact zone and on at least one of the web portions extending between the second guide roll and the contact zone.

6. A method as claimed in claim 1, further including the steps of conveying the web over a support roll, a first guide roll, a second guide roll, and a third guide roll which is so situated that the web portion being conveyed from the second to the third guide roll is deflected by the support roll to form a contact zone with the web portion supported by the support roll, supplying the coating composition to the web on the web portion being conveyed from the support roll to the first guide roll as well as on the web portion being conveyed from the second guide roll to the contact zone, and drying the web when it is being conveyed from the first guide roll to the second guide roll.

7. A method as claimed in claim 1, further including the steps of providing an intermediate wiper between the first zone and the second zone of the web for wiping off the excess of coating composition from the first zone of the web, transporting said excess to the second zone of the web, and delivering said excess to said second zone, wherein said other zone is deflected into contact with said intermediate wiper to thereby indirectly contact said one zone.

8. A method as claimed in claim 7, in which said intermediate wiper is an endless belt.

9. Apparatus for coating a web with a coating composition, comprising:

means for continuously conveying the web;

means for supplying the coating composition in excess to a first zone on the web;

means for providing a backing support for one of said first zone and a second, uncoated zone of the web; and means for guiding the web and deflecting the other of said first and second zones into contact with said one zone such that the back of said other zone is unsupported in the area of the contact, whereby the uncoated second zone of the web wipes excess coating composition from the first zone of the web.

10. An apparatus as claimed in claim 9, characterized in that it contains a support roll, over which the web is continuously conveyed, at least one first guide roll and one second guide roll for the web, both these guide rolls being so placed in relation to the support roll that the web portion being conveyed between the guide rolls is deflected by the support roll to form a contact zone with the web portion supported by the support roll, and that a supply means for the coating composition is arranged in the space between the two web portions extending between one guide roll and said contact zone.

11. An apparatus as claimed in claim 10, characterized in that one guide roll is movably mounted to enable variation of the length of the contact zone.

12. An apparatus as claimed in claim 9, comprising an intermediate wiper for wiping off the excess of coating composition from the coated portion of the web, transporting said excess to an uncoated portion of the web and delivering said excess of said uncoated portion.

13. An apparatus as claimed in claim 12, in which the intermediate wiper is an endless belt.

* * * * *